252-102 AU 165 EX
5/3/77 XR 4,021,264

United States Patent [19]
Knorre et al.

[11] 4,021,264
[45] May 3, 1977

[54] METHOD OF DISSOLVING A SILVER COATING IN A PHOTO TANK

[75] Inventors: Helmut Knorre, Seligenstadt; Joachim Fischer, Grossauheim, both of Germany

[73] Assignee: Deutsche Gold- und Silber-Scheideanstalt vormals Roessler, Frankfurt, Germany

[22] Filed: Oct. 20, 1975

[21] Appl. No.: 624,180

[52] U.S. Cl. ..... 134/3; 75/118 P; 134/22 R; 134/42; 252/100; 252/102
[51] Int. Cl.[2] ..... B08B 3/08
[58] Field of Search ..... 134/2, 3, 22 R, 42; 252/79.1, 100, 102; 75/118 P; 96/119 S

[56] References Cited

UNITED STATES PATENTS

| | | | |
|---|---|---|---|
| 2,304,427 | 12/1942 | Sibley | 75/118 P |
| 2,585,616 | 2/1952 | Barnes | 134/3 |
| 3,434,796 | 3/1969 | Colombo et al. | 134/2 X |
| 3,625,908 | 12/1971 | Magin | 134/3 X |
| 3,738,867 | 6/1973 | Franz | 134/2 |

OTHER PUBLICATIONS

Remy, Treatise on Inorganic Chemistry, 1956, p. 198.

*Primary Examiner*—S. Leon Bashore
*Assistant Examiner*—Marc L. Caroff
*Attorney, Agent, or Firm*—Cushman, Darby & Cushman

[57] ABSTRACT

Silver coatings in photographic tanks are dissolved with an aqueous solution of an alkali mono or di peroxysulfate, an alkali bisulfate and thiourea.

6 Claims, No Drawings

METHOD OF DISSOLVING A SILVER COATING IN A PHOTO TANK

It is known to treat calcium and silver coatings in industrial photographic apparatus such as developer pans and developer tanks with aqueous solutions of potassium cyanide, nitric acid, with concentrated sulfuric acid or with alkali hypobromite solutions. These agents are not harmless and also from the standpoint of protecting the environment are not desirable.

Furthermore, it is known to use for the purification to employ in acid solution salts with high oxidation potentials such as potassium bichromate, potassium permanganate and ceric sulfate, see German Auslegeschrift 1068840. However, using dilute solutions the speed of dissolving the silver is not sufficiently great so that here also concentrated solutions must be added and thereby again environmental problems occur.

There have also been used alkali ferricyanides with thiosulfates as reducing agents, see German Democratic Republic patent 23348. However, in this case also for effective dissolution of silver there are added very concentrated solutions.

Besides it is known to use thiourea to dissolve silver patches, see the published German application B 19480 IVa/57b.

In contrast it has now been found that silver patches in industrial photographic apparatus can be quickly and safely removed if there are used aqueous solutions of an alkali peroxy mono or di sulfate, alkali bisulfate and thiourea containing 10–150 grams/liter or alkali peroxy mono or disulfate (or mixture of alkali peroxy mono and disulfate) 20–200 grams/liter of alkali bisulfate and 5–100 grams/liter of thiourea to remove the silver.

When a mixture of peroxy mono and disulfates (mono and di persulfates) is used then can be employed in widely varying ratios, e.g. 1:1 by weight.

As alkali peroxy sulfates there can be used for example sodium peroxy monosulfate, potassium peroxymonosulfate, sodium ammonium peroxymonosulfate, sodium peroxydisulfate, ammonium peroxydisulfate, and potassium peroxydisulfate. As alkali bisulfates there can be used for example sodium bisulfate, ammonium bisulfate and potassium bisulfate.

Furthermore, if needed there can be added known complex formers for alkaline earth metals, i.e., above all for calcium, to remove calcium deposits in the tank. For example, there can be used citric acid and tartaric acid (or other hydroxycarboxylic acid complexing agents). Thus, the complexing agents can be added in an amount of 1–5% by weight based on the total amount of peroxy compound, bisulfate and thiourea.

Unless otherwise indicated all parts and percentages are by weight.

The amounts of the individual components can be combined with each other in any combination within the stated ranges.

For production of solutions on the one hand there is dissolved the peroxy mono or di sulfate and bisulfate as the first ingredient (A) and on the other hand thiourea, if desired also containing 5–50 grams of sodium sulfate, as the second ingredient (B). Thiourea and the oxidation agent should not be stored together.

The preferred amounts of materials are 10–40 g/l of alkali peroxy mono and/or di sulfate, 100–180 g/l alkali bisulfate and 25–60 g/l of thiourea. The preferred peroxy mono sulfate is the potassium salt, the preferred peroxy disulfate is the ammonium salt and alkali bisulfate is the sodium salt.

There can be used a temperature from room temperature up to 45° C for forming the solutions. The silver spots or batches can also be treated in this temperature range.

In contrast to the prior art processes the process of the invention clearly reduces the load on the environment, especially if the solution resulting after dissolving the silver is treated with $H_2O_2$ in the manner described in Hahn German Offenlegungsschrift 2009826 and thereby the residual thiourea is destroyed. The entire disclosure of Hahn is hereby incorporated by reference and relied upon.

Sodium ammonium peroxymono-sulfate can be prepared in conventional manner, e.g., as shown in Beer German patent 1113212, the entire disclosure of which is hereby incorporated by reference and relied upon.

The invention will be further illustrated by the following examples.

EXAMPLE 1

A heavy silver coating in a photographic pan was dissolved within two minutes at room temperature by an aqueous purification mixture which contained 45 grams of potassium peroxy monosulfate, 40 grams of thiourea, 140 grams of sodium bisulfate as well as 25 grams of sodium sulfate per liter of solution. A separation of sulfur did not occur.

EXAMPLE 2

The same silver coating was dissolved in about 4 minutes at the same temperature in an aqueous solution which contained per liter 22.5 grams of potassium peroxymonosulfate, 20 grams of thiourea, 70 grams of sodium bisulfate and 12.5 grams of sodium sulfate. The solution remained clear.

EXAMPLE 3

The same silver coating disappeared after about fifteen minutes when there was employed a solution of 11 grams of potassium peroxymonosulfate, 10 grams of thiourea, 35 grams of sodium bisulfate and 6 grams of sodium sulfate in 1 liter of water.

EXAMPLE 4

The same silver coating was dissolved in three minutes with an aqueous solution that contained per liter 115 grams of alkaliperoxymonosulfate (potassium peroxymonosulfate), 30 grams of thiourea and 70 grams of sodium bisulfate. A sulfur separation occurred after about 4 hours.

EXAMPLE 5

The same silver coating as in Example 1 was dissolved in 1.5 minutes at room temperature in an aqueous solution which contained 45 g/l $(NH_4)_2 S_2O_8$; 140 g/l $NaHSO_4$ and 30 g/l of thiourea. After about 20 hours sulfur separation occurred.

EXAMPLE 6

The same silver coating as in Example 1 was dissolved in 5 minutes with an aqueous solution that consisted of 22.5 g/l $(NH_4)_2 S_2O_8$; 70 g/l of $NaHSO_4$ and 15 g/l of thiourea.

EXAMPLE 7

Example 6 was repeated but using an aqueous solution of 11 g/l $(NH_4)_2S_2O_8$; 25 g/l $NaHSO_4$ and 10 g/l of thiourea. The dissolution of the silver required 15 minutes.

The composition can comprise, consist essentially of or consist of the materials set forth.

What is claimed is:

1. A process for the removal of the silver coating of a silver coated container comprising dissolving the coating by adding to the container and in contact with said coating an aqueous solution containing (a) 10–150 g/l of a member of the group consisting of an alkali peroxymonosulfate, an alkali peroxydisulfate and a mixture of an alkali peroxymonosulfate and an alkali peroxydisulfate, (b) 20–200 g/l of alkali bisulfate and (c) 5–100 g/l of thiourea.

2. A process according to claim 1 wherein (a) comprises potassium peroxymonosulfate, sodium ammonium peroxymonosulfate, sodium peroxymonosulfate, potassium peroxydisulfate, sodium peroxydisulfate or ammonium peroxydisulfate.

3. A process according to claim 2 wherein (b) is sodium bisulfate or potassium bisulfate.

4. A process according to claim 1 including adding to the aqueous solution 5–30 grams per liter of sodium sulfate.

5. A process according to claim 1 wherein there is employed 10–40 g/l of (a), 100–180 g/l of (b) and 25–60 g/l of (c).

6. A process according to claim 5 wherein the aqueous solution consists essentially of water, (a), (b), (c) and sodium sulfate.

* * * * *